United States Patent [19]

Tetenborg et al.

[11] 4,258,524

[45] Mar. 31, 1981

[54] APPARATUS FOR FOLDING ONTO THEMSELVES THE FLATTENED FILLING APERTURES OF LARGE SACKS AND FOR CLOSING SAME BY CLOSURE STRIPS

[75] Inventors: Konrad Tetenborg; Helmut Hüwelmann, both of Lengerich of Westphalia, Fed. Rep. of Germany

[73] Assignee: Windmoller & Holscher, Lengerich of Westphalia, Fed. Rep. of Germany

[21] Appl. No.: 37,349

[22] Filed: May 9, 1979

[30] Foreign Application Priority Data

May 16, 1978 [DE] Fed. Rep. of Germany ..... 2821444

[51] Int. Cl.[3] ..... B65B 51/06; B65B 51/10; B65B 7/08

[52] U.S. Cl. ..... 53/137; 53/379

[58] Field of Search ..... 53/378, 379, 137, 388

[56] References Cited

U.S. PATENT DOCUMENTS

| | | | |
|---|---|---|---|
| 3,150,477 | 9/1964 | Keene | 53/378 X |
| 3,206,911 | 9/1965 | Carle et al. | 53/137 |
| 3,543,466 | 11/1968 | Forsberg | 53/137 X |
| 4,069,646 | 1/1978 | Slomp et al. | 53/137 X |

*Primary Examiner*—Horace M. Culver
*Attorney, Agent, or Firm*—Fleit & Jacobson

[57] ABSTRACT

A piston-cylinder unit causes a web of closure tape material to be withdrawn from a supply reel in steps equal to the width of each closure tape required for closing the folded-over flattened mouth end of a large sack. Each tape is severed from the leading web end by a knife and engaged by a suction bar which is swung together with two welding bars onto an inclined support for the folded-over mouth end.

12 Claims, 8 Drawing Figures

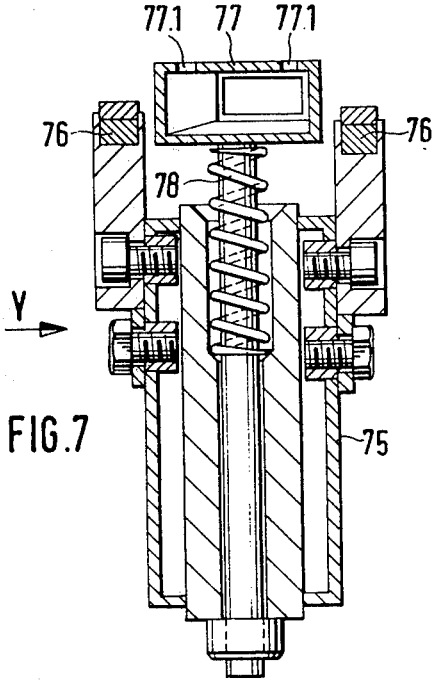
FIG.7
FIG.8
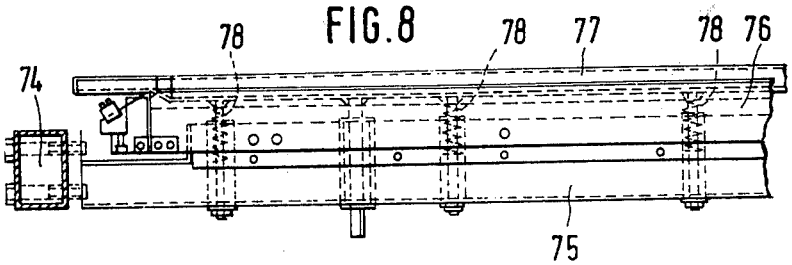

APPARATUS FOR FOLDING ONTO THEMSELVES THE FLATTENED FILLING APERTURES OF LARGE SACKS AND FOR CLOSING SAME BY CLOSURE STRIPS

The invention relates to an apparatus for folding onto themselves the superposed walls of the flattened filling ends of filled large sacks of thermoplastic film and for welding a closure strip that has been placed on the folded-over end and projects therebeyond to the folded-over end and the adjoining sack wall.

DE-OS No. 26 47 432 discloses a sack which is made from a tube section of a fabric of plastics threads or plastics tapes coated on the outside or laminated on the outside with plastics film and which, by reason of its size and the strength of its material, can accommodate pourable material with a weight of 1 t and higher. In DE-OS No. 26 52 010 a method has been described by which such large sacks can be filled and closed fully automatically. According to this method, the filling ends of the large sacks are closed after filling by stretching the side walls, the walls of the sack above the contents are placed together and are turned over to one side through an angle. Subsequently, the flattened filling end of the large sack is folded over onto itself, a closure strip is placed on the folded-over end and the adjoining sack wall, and the strip is connected to the wall of the sack and the folded-over end by two parallel weld seams. The empty upper end of the sack is then re-erected to extend vertically, laid into a zig-zag fold and pulled together to form a frill which can subsequently be secured against springing open by means of a ring or by welding the free ends of the closure strip. Filling and closing of the large sacks takes place continuously, conveying means being provided which feed the large sack filled at the filling station in an upright position through the stations containing the individual closure apparatuses.

The aforementioned apparatus serves to fold the flattened filling end and for applying the closure strip to the folded-over end of the flattened filling end and thus forms one station of the closure plant for filled large sacks.

It is the problem of the present invention to provide an automatic and reliably operative apparatus of the aforementioned kind by which the large sacks can be continuously moved for closing purposes.

According to the invention, this problem is solved in that a table-like plate is provided which extends obliquely to the vertically standing filled sack, is arranged above the contents, terminates at a spacing in front of the medial plane of the sack defined by the vertically placed flattened filling end, against which the flattened filling end can be applied, and which adjoins a flap pivotable onto the plate for turning over the end of the filling end, that bars secured to levers mounted in the machine frame can be swung into the gap between the plate and the flap to take along and form the fold line of the flattened filling end and lie only on the lateral regions of the filling end, that means are provided for intermittently withdrawing closure strips in steps equal to the closure strip width from a supply reel having a width corresponding to the length of the closure strip, that a guide for the front end of the web withdrawn from the supply reel leads same between tong-like cooperating clamping jaws between which there is a knife for severing the closure strip, and that a suction bar secured to pivotal levers in front of the clamping jaws as viewed in the feeding direction of the web holds the part of the closure strip projecting beyond the clamping jaws and is bounded by two welding bars which can be swung with the suction bar onto the plate serving as a backing plate and weld the closure strip held by the plate to the margin of the folded-over end on the one hand and to the adjoining sack wall on the other hand. The filled large sacks can be continuously moved into the apparatus according to the invention by conveyor means and continuously out again, the filling end of the filled sack being prepared in the apparatus of the invention for the subsequent formation of the frill.

After welding on the closure strip, which desirably projects beyond both sides of the flattened filling end so that its ends can be welded to each other after gathering the filling end into a frill for the purpose of fixing same, the obliquely positioned flattened filling end is erected vertically into the medial plane of the sack by swinging upwardly the bars which engage laterally under the fold lines of the folded-over end. The flattened filling end is released from the bars engaging in the folded-over end in that the filling end is gathered towards the centre in concertina fashion during formation of the frill and can be pulled out between the bars.

Advantageous embodiments of the invention have been described in more detail in the subsidiary claims.

One example of the invention will now be explained in more detail with reference to the drawing, in which:

FIG. 7 is a section on the line VII-13 VII in FIG. 4, and

FIG. 8 is an elevation of the apparatus taken in the direction of the arrow Y in FIG. 7.

Figure 1:
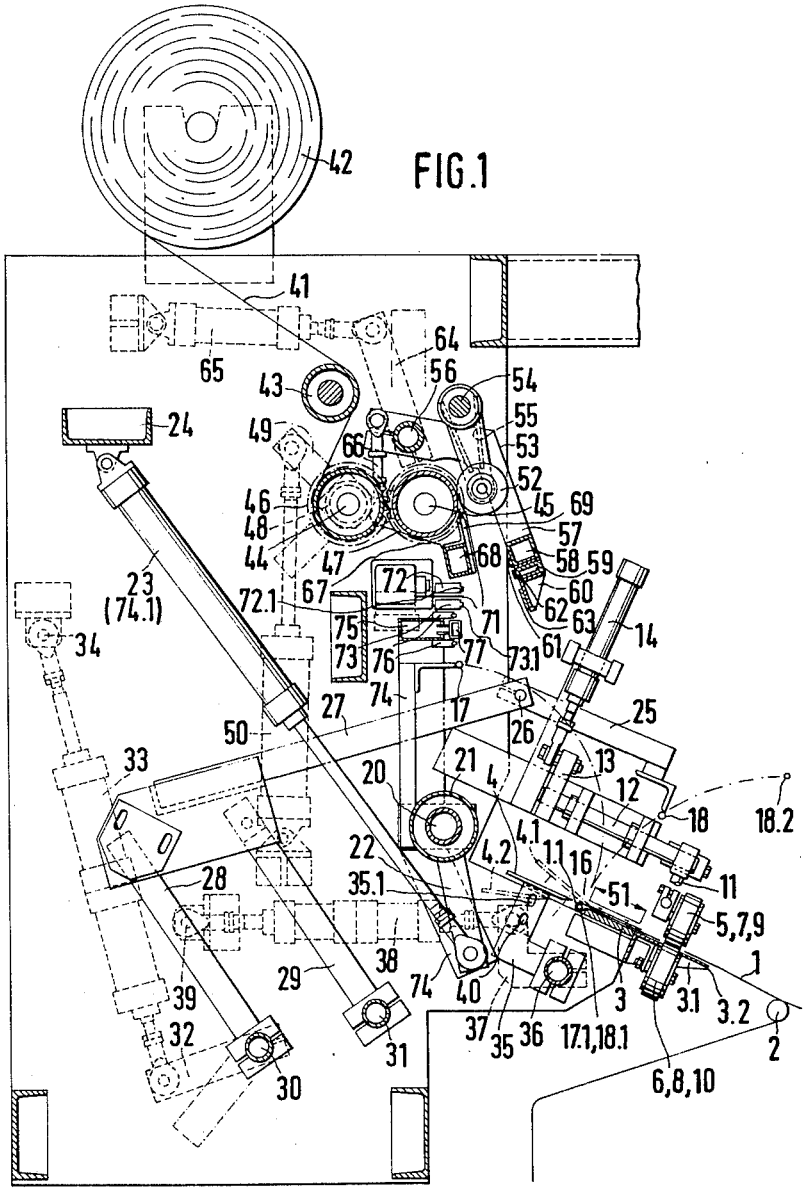
FIG. 1 is a section through the apparatus for folding and closing the flattened filling end with a closure strip transversely to the direction of movement of the sack through the closure plant.
Figure 2:
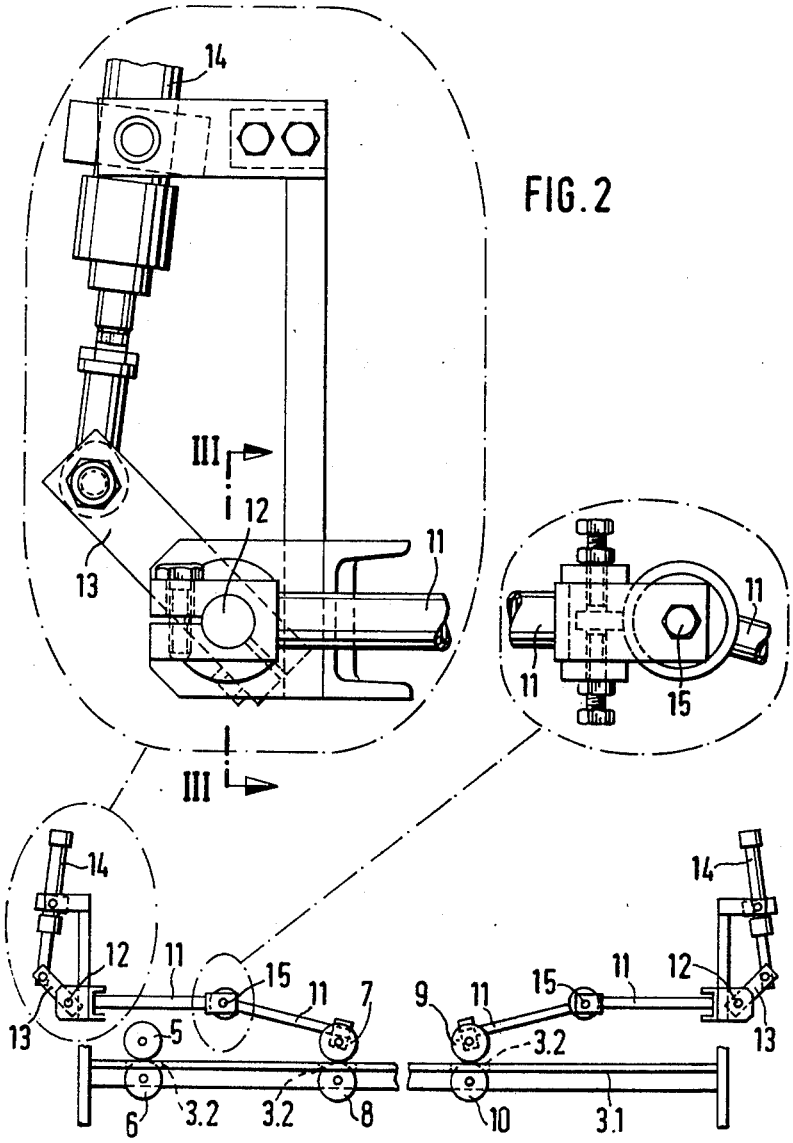
FIG. 2 is a side elevation of the rollers holding the flattened filling end.
Figure 3:
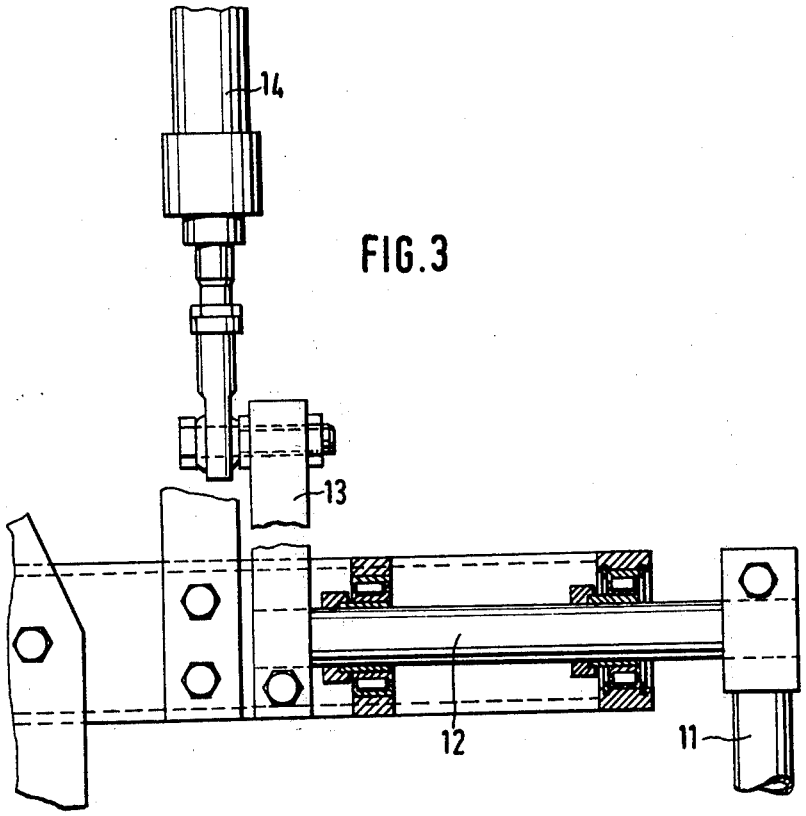
FIG. 3 is a section on the line III—III in FIG. 2.
Figure 4:
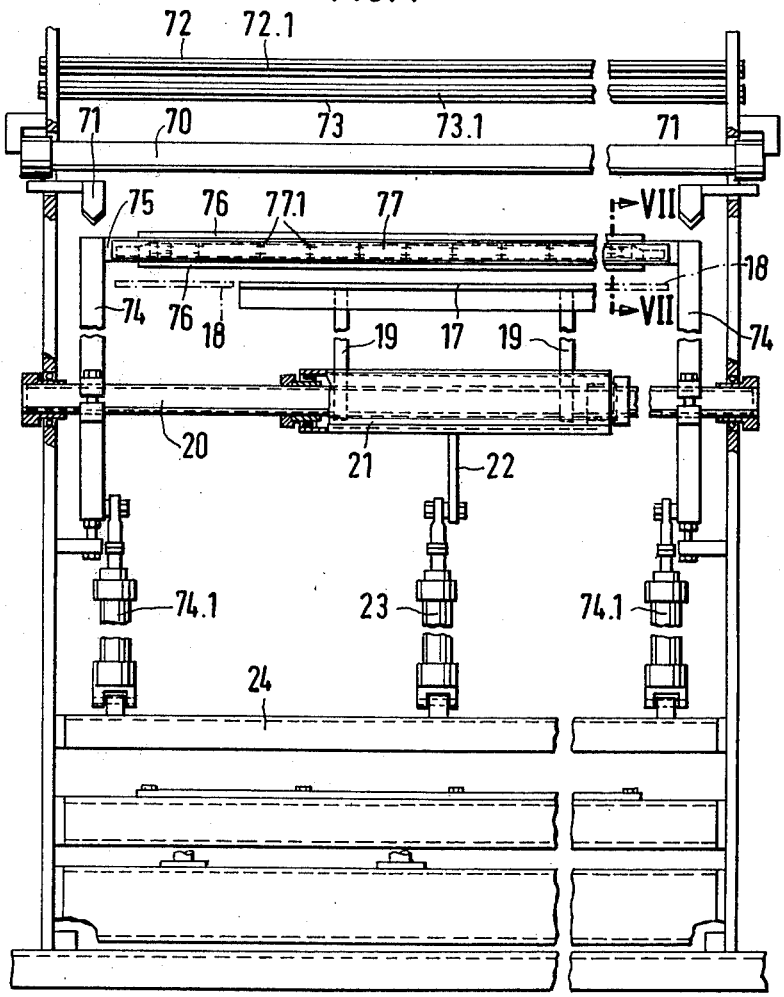
FIGS. 4, 5 and 6 are elevations of the apparatus in the direction of the arrow X in FIG. 1.
Figure 5:
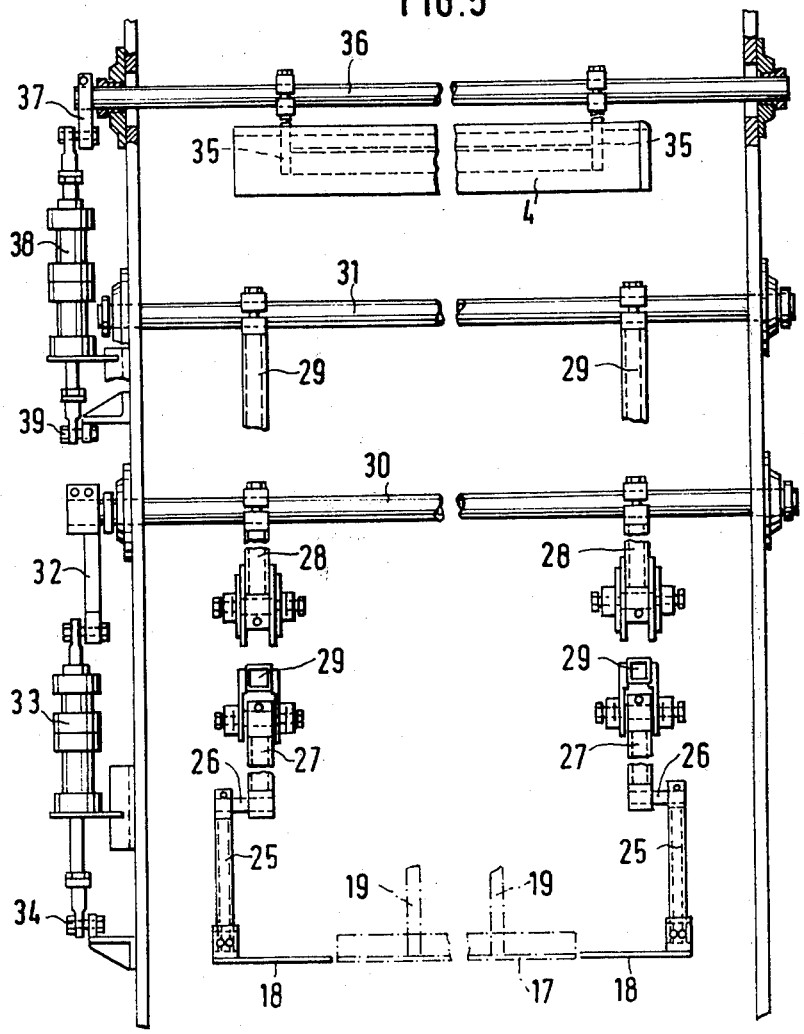
Figure 6:
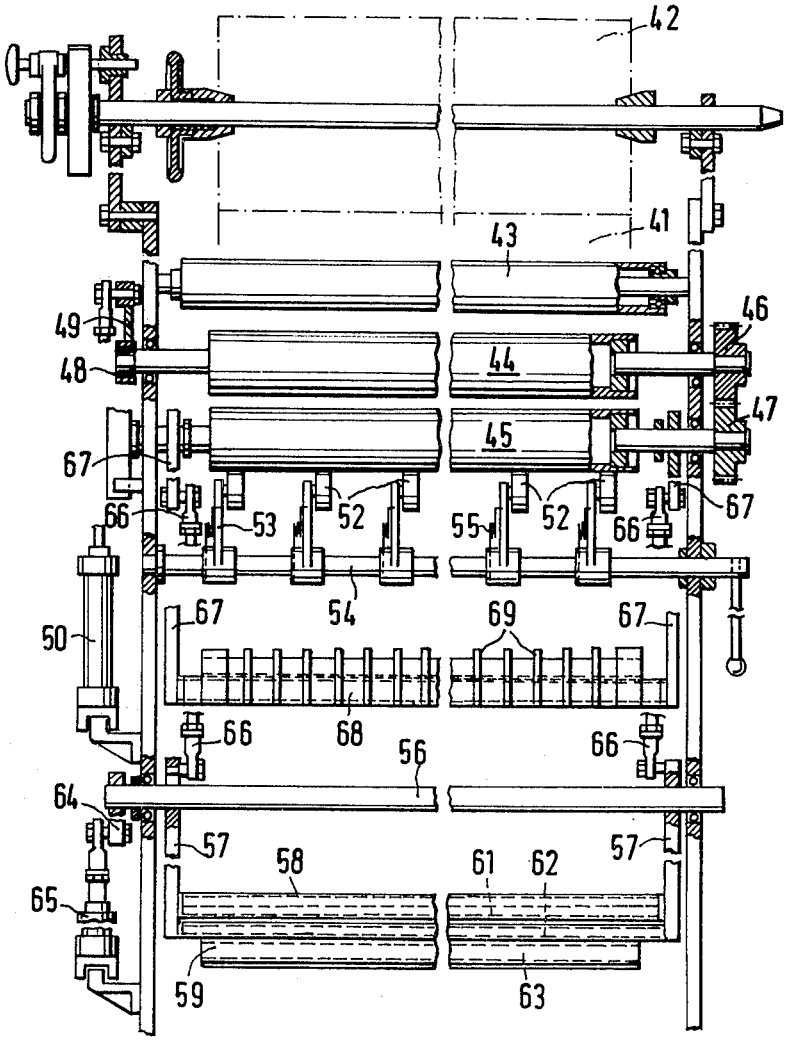

The large sack 1 of which only the upper portion is shown in FIG. 1 stands on a pallet (not shown) which is advanced perpendicular to the plane of the drawing by a driven roller track. The large sack 1 has been filled at a filling station and is moved through the closure plant of which the apparatus described hereinafter forms one station.

After filling, a filling aperture 1.1 of a large sack 1 has been flattened and folded over to the left-hand side through about 25° over a bar 2 and placed on a table (not shown) which is inclined at this angle and the upper narrow end of which is designated 3 in FIG. 1 and is adjoined by a flush guide plate 3.1 for guiding the filling aperture 1.1. In registry with this table there is a plate 4. The filling aperture 1.1 is, together with the large sack 1, moved towards the tail end 3 and to the plate 4. During advancing motion of the filled large sack 1 on the rollertrack, the flattened upper end of the large sack 1 is held by pairs of rollers 5, 6; 7, 8 and 9, 10. These pairs of rollers serve to hold the flattened sack end during feeding and prevent it from falling back onto the sack. The rollers 6, 8 and 10 are rotatably mounted at a position fixed with respect to the frame. The roller 5 is resiliently mounted. Apertures 3.2 are provided for them in the guide plate 3.1. Each of the rollers 7 and 9 is freely rotatable on levers 11 which are secured on a shaft 12 loosely rotatable in bearings that are fixed with respect to the frame. A lever 13 is fixed to the shaft 12; the free end of the lever is hinged to a piston rod of a piston-cylinder unit 14 which is pivoted to the frame. The levers 11 are segmented and substantially at the middle have a joint 15 which can be loosened and set. The rollers 7, 9 are resiliently applied to the rollers 8, 10.

Between the tail end 3 and the plate 4 there is a gap 16 into which the bars 17, 18 can be swung. The bars 17, 18 there assume the positions 17.1, 18.1 and are flush in the swung-in condition. The bars 18 thereby adjoin the bar 17 to the right and left. The bar 17 is secured to two levers 19 which are fixed to a tube 21 rotatably mounted on a shaft 20 which is rotatably mounted in the frame. A lever 22 welded to the tube 21 has its free end hinged to a piston rod of a piston-cylinder unit 23. The cylinder of the piston-cylinder unit 23 is pivoted to a cross-member 24 which is fixed with respect to the frame. By actuating the piston-cylinder unit 23, the bar 17 is swung into the gap 16 out of the position shown in FIG. 1.

The bars 18 are fixed to levers 25 of which the free ends are clamped on pins 26 secured to levers 27 which act as coupling members. The bars 18 can be adjusted to the desired position in the gap 16 by loosening and retightening the clamping connection. Cranks 28 and swing arms 29 are pivoted to the levers 27, the cranks 28 being connected to a shaft 30 rotatable in the frame and the swing arms 29 being connected to a shaft 31 rotatable in the frame. A lever 32 secured to the shaft 30 has its free end pivoted to the piston rod of a tandum piston-cylinder unit 33. The latter consists of two piston-cylinder units of which the cylinders are secured to each other. The piston rod of the second piston-cylinder unit is pivoted to a pin 34 secured to the frame. By actuating the tandum piston-cylinder unit 33, the bars 18 can be moved to three positions, namely the position 18 shown in full lines, the position 18.1 within the gap 16, and a position 18.2. The bars 18 are moved to this position 18.2 when the filling end 1.1 of the large sack 1 is to be brought to a vertical position after application of the closure strip.

The bar 17 is swung in first and the bars 18 follow. Thereafter the bar 17 is swung back to the starting position. By swinging the bars 17, 18 into the positions 17.1 and 18.1 by means of the piston-cylinder units 23 and 33, the filling end 1.1 of the large sack 1 lying loosely on the tail end 3 and the plate 4 is pressed into the gap 16. The filling end 1.1 which is still held in the gap 16 by the bars 18 is folded onto itself by the plate 4. For this purpose it is connected to levers 35 which are keyed to a shaft 36 loosely rotatable in the frame. A lever 37 fixed to the shaft 36 has its free end hinged to a tandum piston-cylinder unit 38. The latter consists of two piston-cylinder units of which the cylinders are fixed to each other. The piston rod of the second piston-cylinder unit is hinged to a pin 39 fixed to the frame. By actuating the tandum piston-cylinder unit 38, the plate 4 can be moved to three positions, namely the position 4 shown in full lines, the position 4.1 in which the filling end 1.1 is folded onto itself by the plate 4, and a position 4.2 in which the plate 4 is withdrawn from the fold line to provide enough space for the filling end 1.1 when the filling end 1.1 is erected to the vertical position after welding on of the closure strip. At its underside, the plate 4 has an inclined face 4.3 with which it presses on the filling end in the position 4.1. The levers 35 are segmented and at the part facing the plate 4 are provided with elongate holes 35.1 through which there are passed securing bolts 40 from the other part with which both parts can be screw-connected and are relatively displaceable by means of the elongate holes 35.1 whereby the position 4 of the plate 4 can be set with respect to the tail end 3.

A closure strip withdrawn as a web 41 from a supply reel 42 is applied to the filling end 1.1 which has been folded onto itself by the plate 4. The web 41 has a width which is larger than the width of the flattened large sack 1. The web 41 is withdrawn over rollers 43, 44 and 45. The roller 43 is loosely rotatable on a shaft fixed to the frame. The rollers 44 and 45 have stub axles which are also loosely rotatably mounted in the frame. Interengaging spur gears 46, 47 are keyed to the stub axles on one side. On the other side a free-wheeling device 48 is secured to the stub axle of the roller 44. The piston rod of a piston-cylinder unit 50 is hinged to a lever 49 fixed to the outer ring of the free-wheeling device. The cylinder of the piston-cylinder unit 50 is hinged to the frame. On actuating the piston-cylinder unit 50, the rollers 44, 45 are turned on through about 90° which, measured in radians, corresponds to the width 51 of the closure strip. On returning the lever 49 to its starting position, the roller 44 remains stationary because of the action of the free-wheeling device 48 and an additional brake. Ten rollers 52 lie against the roller 45. They are loosely rotatably mounted on levers 53 of which the free ends are rotatably mounted on a shaft 54. The rollers 52 are pressed against the roller 45 by coiled bending springs 55 and thereby facilitate unimpeded advance of the web 41.

Two levers 57 are keyed to a shaft 56 rotatably mounted in the frame parallel to the rollers 44, 45. The levers 57 carry two square tubes 58, 59 as well as a supporting plate 60 on which elastic pressure bars 61, 62 and 63 are cemented. A lever 64 keyed to the shaft 56 has its free end hinged to a piston rod of a piston-cylinder unit 65 of which the cylinder is pivoted to the frame. The levers 57 are articulated by thrust rods 66 to two double levers 67 which are rotatably mounted on the stub axles of the roller 45 and are screw-connected to a square tube 68. On twenty-five bars 69 provided on the square tubes 68, the fed web 41 is supplied to severing and welding means which will be described hereinafter.

A piston-cylinder unit 70 is fixed to the frame parallel to the rollers 44,45 and through it there is passed a severing knife 71 which can be moved over the entire width of the web 41 in known manner. The severing knife 71 cuts strips of a width 51 from the web 41. The severing knife 71 is double-edged so that one cut can be made during each forward and return stroke.

At both sides adjacent the severing knife 71 or adjacent the path traversed by the severing knife 71 there are pressure bars 72, 73 which are fixed with respect to the frame, provided with projections 72.1, 73.1 extending over the entire length of the backing bars, and correspond to the elastic pressure bars 61, 62. The severing knife 71 is passed between the pressure bars 61, 62 during cutting.

Double levers 74 keyed to the shaft 20 serving as a pivot for swinging the bar 17 have a cross-member 75 with two welding bars 76 secured to their one free end. The other ends of the double levers 74 are hinged to piston-cylinder units 74.1 of which the cylinders are pivoted to the frame. A resilient pressure or suction bar 77 between the two welding bars 76 has an operative surface projecting beyond the welding bars 76. It can be pushed back to the plane defined by the welding bars 76 against the spring force of supporting springs 78. By means of a controlled lead, it is connected to a source of suction air (not shown) and provided with suction holes 77.1 with which the strips severed by the severing knife 71 are attracted by suction. The severing operation and welding on of the closure strips proceeds as follows:

By actuating the piston-cylinder unit 50, the rollers 44, 45 are turned and the web 41 is thereby advanced by the width 51. The bars 69 and the levers 57 or the square tubes 58, 59 are in the position shown in FIG. 1. The bars 69 swung out beyond the plane defined by the operative edges of the backing bars 72, 73 and the suction bar 77 prevent the advanced web 41 from striking one of these components and thereby giving rise to defective operation. The piston-cylinder unit 65 is then actuated, whereby the levers 57 are swung with the elastic pressure bars 61 to 63 towards the backing bars 72, 73 and the suction bar 77. The severing knife 71 is thereupon actuated and the closure strip of the width 51 is severed from the web between the backing bars 72, 73. At the same time, the suction air is switched to the suction bar 77 which attracts the closure strip by suction. After returning the pressure bars 61 to 63 by resetting the piston-cylinder unit 65, the way is clear for applying the closure strip to the filling end 1.1 of the large sack 1 that has been folded onto itself. This occurs by actuating the piston cylinder unit 74.1, whereby the levers 74 and the welding bars 76 are swung to the welding position.

When the closure strip lies on the filling end 1.1, current is applied to the welding bars 76 and the closure strip is on the one hand welded to the turned-over filling end and, by a second weld seam parallel to the first, to the wall of the sack over the entire width of the large sack 1. At the same time, the suction air for the suction bar 77 is switched off.

After welding, the welding bars 76 can be withdrawn from the closure strip without the closure strip being lifted off again by reason of the seams which are still at welding heat, because the suction bar 76 still presses the closure strip against the large sack 1. The welding bars 76 resume the FIG. 1 position after welding so that the filling end or the empty upper flattened sack wall portions can be transferred to a vertical position, which is necessary for the subsequent operation of forming the frill. Upward swinging is effected by appropriate actuation of the tandum piston-cylinder unit 33 so that the bars 18 are moved to the position 18.2 and take the filling end with them into this position. By forming the frill, the bars 18 are released from the large sack 1 again and can be swung back to the starting position 18.

The circuit of the apparatus is designed as a sequence circuit, i.e. the movement of the preceding component must have been concluded before the movement of the next component is initiated. This is achieved by limiting switches or, as in the present case, by magnetic switches, the switches fixed with respect to the frame co-operating with pins or screws which are secured to the moving components and give rise to signals. The signals of the magnetic switches are transmitted to intermediate circuits and there processed in known manner.

We claim:

1. Apparatus for folding a superposed wall of a flattened filling end of a filled large sack of thermoplastic film onto itself and for holding a closure strip placed on the folded-over end and projecting therebeyond to the adjoining sack wall, said apparatus comprising a machine frame; a table-like plate (3) which extends obliquely to a vertically standing filled sack (1), is arranged above the contents of the sack, and terminates at a spacing in front of a medial plane of the sack defined by a vertically placed flattened filling end (1.1) of the sack, the flattened filling end (1.1) being applied to said plate; a flap (4) adjoining and pivotal onto the plate for turning over the end of the filling end (1.1); bars (18) for engaging the filling end; levers (25, 27) mounted in the machine frame for carrying said bars (18) for swinging movement into a gap (16) between the plate (3) and the flap (4) so that the bars take along and form a fold line in the flattened filling end (1.1), said bars extending over lateral regions of the filling end; a supply reel (42) for an adhesive web of closure strips (41) supported by the machine frame; means for intermittently withdrawing the adhesive web of closure strips (41) from said supply reel in steps equal to a desired closure strip width (51), the supply reel (42) having a width corresponding to the length of the closure strip; tong-like cooperating clamping jaw means (72, 73), (62, 63) for clamping the web (41) withdrawn from the supply reel (42); guide means for guiding a front end of the web (41) between the clamping jaw means; a knife (71) for severing the closure strip from the web; suction bar means (77) for holding severed closure strips; pivotal levers (74) positioned in front of the clamping jaws as viewed in the feeding direction of the web (41) for securing the suction bar means in such manner that a part of the closure strip projecting beyond the clamping jaws is bounded by the welding bar means (76), the welding bar means being swingable with the suction bar means (77) onto the plate (3), which serves as a backing plate, during welding of the closure strip held by the plate to a margin of the folded-over end and to the sack wall.

2. Apparatus according to claim 1, characterized in that rows of cooperating pressure rollers are arranged at both sides of the inclined flattened filling end (1.1) which lies on the plate (3).

3. Apparatus according to claim 2, characterized in that the apparatus further comprises an extension (3.1) adjoining the table-like plate (3), and in that at least one of the extension and the table-like plate is provided with apertures (3.2) in regions where the rollers are disposed.

4. Apparatus according to claim 2 or 3, characterized in that pressure rollers (6, 8, 10) of one of the rows of cooperating pressure rollers are fixed with respect to the frame, and in that the apparatus includes pivotal lever means (11) for mounting at least one of the pressure rollers (7, 9) of the other row.

5. Apparatus according to claim 4, characterized in that the apparatus further comprises a pivotal shaft (12) for supporting the pivotal lever means (11) and a pneumatic piston-cylinder unit (14) for controlling movement of the pivotal shaft (12).

6. Apparatus according to claim 4, characterized in that the apparatus includes an adjustable hinge (15), and in that the pivotal lever means (11) includes a segmented lever having parts thereof interconnected by said hinge.

7. Apparatus according to claim 1, characterized in the the apparatus further comprises a four-pivot system having guide members (28, 29), a crank (30, 32) connected to one of the guide members (28), and a pneumatic piston-cylinder unit (33) for controlling movement of the crank, the levers (25, 27) carrying the bars (18) being hinged to the guide members (28, 29).

8. Apparatus according to claim 1, characterized in that the apparatus includes lever means (19) flush with the bars (18) in the condition when swung into the gap (16), and a central bar (17) positioned between the bars (18) and hinged to the lever means (19).

9. Apparatus according to claim 1, characterized in that the guide means for the closure web (41) withdrawn from the supply reel (42) includes two cooperating transporting rollers (44, 45), a piston-cylinder unit (50), a free-wheeling device (48), and a lever (49), one of the transporting rollers (49) being intermittently driven by the piston-cylinder unit (50) by way of the free-wheeling device (48) and the lever (49).

10. Apparatus according to claim 1, characterized in that the guide means includes a roller (45) guiding movement of the web (41), rollers (52), and spring-biased levers for mounting the rollers (52), the web (41), in a region where it runs off the roller (45), being pressed thereagainst by the rollers (52) mounted on the spring-biased levers (53).

11. Apparatus according to claim 1, characterized in that the clamping jaw means comprises pivotable levers (57), two pressure bars (72, 73) which are fixed with respect to the frame and between which the severing knife (71) is mounted, and two pressure bars (61, 62) which are secured to the pivotable levers (57) and which cooperate with the pressure bars (72, 73) in a tong-like manner.

12. Apparatus according to claim 1, characterized in that the suction bar means (77) projecting beyond the welding bar means (76) is adapted to be pressed between the welding bar means (76) against spring force.

* * * * *